US008757225B2

(12) United States Patent
Knieling

(10) Patent No.: US 8,757,225 B2
(45) Date of Patent: Jun. 24, 2014

(54) APPARATUS FOR FILLING CONTAINERS WITH MULTICOMPONENT LIQUIDS

(75) Inventor: Erwin Knieling, Pfatter (DE)

(73) Assignee: Krones AG, Neutraubling (DE)

( * ) Notice: Subject to any disclaimer, the term of this patent is extended or adjusted under 35 U.S.C. 154(b) by 648 days.

(21) Appl. No.: 12/833,490

(22) Filed: Jul. 9, 2010

(65) Prior Publication Data

US 2011/0005635 A1 Jan. 13, 2011

(30) Foreign Application Priority Data

Jul. 10, 2009 (DE) ..... 10 2009 032 794

(51) Int. Cl.
*B65B 1/04* (2006.01)

(52) U.S. Cl.
USPC ..... 141/104; 141/9; 141/83; 141/90; 141/105; 141/145

(58) Field of Classification Search
USPC ..... 141/9, 83, 90, 100, 102, 104, 105, 107, 141/144, 145
See application file for complete search history.

(56) References Cited

U.S. PATENT DOCUMENTS

| | | | | |
|---|---|---|---|---|
| 2,372,899 A | | 4/1945 | Kantor | |
| 4,538,652 A | * | 9/1985 | Valentin et al. | 141/57 |
| 4,635,825 A | | 1/1987 | Tulasne | |
| 6,655,421 B2 | * | 12/2003 | Kohashi et al. | 141/83 |
| 7,243,483 B2 | * | 7/2007 | Clusserath et al. | 53/473 |
| 2009/0236007 A1 | * | 9/2009 | Clusserath et al. | 141/9 |
| 2011/0000578 A1 | | 1/2011 | Krulitsch et al. | |

FOREIGN PATENT DOCUMENTS

| | | | |
|---|---|---|---|
| DE | 43 24 799 | A1 | 1/1995 |
| DE | 296 17 228 | U1 | 12/1997 |
| DE | 10 2006 045 987 | A1 | 4/2008 |
| DE | 10 2008 010 078 | A1 | 9/2009 |
| EP | 0 159 259 | A1 | 10/1985 |
| EP | 0 354 130 | A1 | 2/1990 |
| EP | 0 483 988 | A1 | 5/1992 |
| EP | 0 775 668 | B1 | 5/1997 |
| WO | 2009/103426 | A1 | 8/2009 |
| WO | 2010/017888 | A1 | 2/2010 |

OTHER PUBLICATIONS

German Search Report Jul. 10, 2009.

* cited by examiner

*Primary Examiner* — Jason K Niesz
(74) *Attorney, Agent, or Firm* — Novak Druce Connolly Bove + Quigg LLP

(57) ABSTRACT

An apparatus for filling containers with liquids and in particular with beverages may include a filling device, which fills the liquid into the container. The filling device has a valve device for controlling the liquid flow into the container including a first supply line for supplying a first liquid to the filling device and comprising a second supply line for supplying a second liquid to the filling device, wherein the first supply line and the second supply line are separate from one another at least in some sections. The apparatus may have a control device configured in such a way that, at the start and at the end of a filling process for a container, this container is filled only with the first liquid.

7 Claims, 2 Drawing Sheets

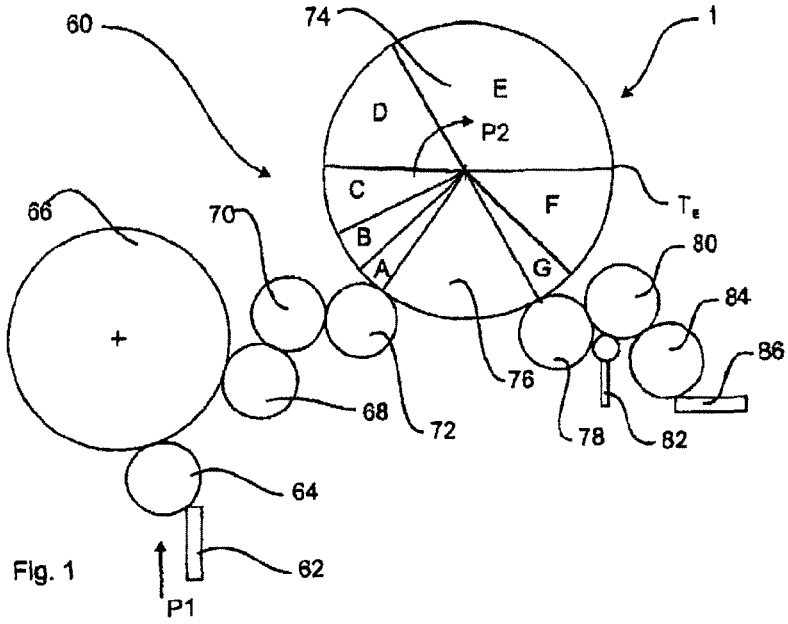
Fig. 1
Fig. 2
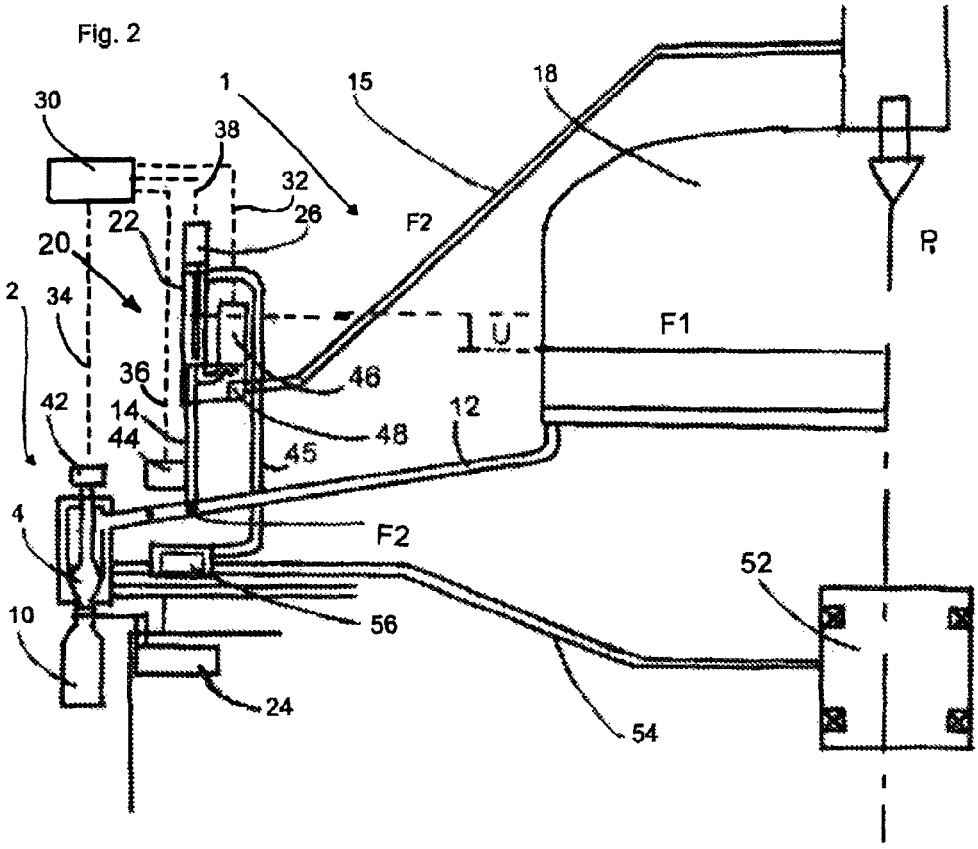

APPARATUS FOR FILLING CONTAINERS WITH MULTICOMPONENT LIQUIDS

CROSS-REFERENCE TO RELATED APPLICATION

This application claims the benefit of priority of German Patent Application No. 10 2009 032 794.0, filed Jul. 10, 2009, pursuant to 35 U.S.C. 119(a)-(d), the disclosure of which is incorporated herein by reference in its entirety as if fully set forth herein.

TECHNICAL FIELD

The present disclosure relates to an apparatus for filling containers with multicomponent liquids.

BACKGROUND

Apparatuses for filling containers with multicomponent liquids have long been known from the prior art and are used for example to produce carbonated mixed beverages. In such a case, a carbonated liquid is enriched with a syrup or the like and is in this way filled into a container.

For filling purposes, use is usually made of filling devices which have a valve, by means of which the filling process can be controlled. Such apparatuses usually also have a volumetric dosing chamber which is connected via a controllable inlet valve to a reservoir for the liquid and via a controllable outlet valve to a filling nozzle.

Beverages such as fruit juices sometimes cause certain problems. These fruit juices sometimes contain fruit pieces or pulp fractions. These fruit pieces can cause undesired lateral splashes and the like at the valve of the filling devices.

An apparatus for bottling liquids is known from DE 43 24 799 A1. Therein, at least one sensor which reacts to the filling level is arranged in dosing chambers, said sensor controlling an inlet valve and an outlet valve. Also provided is at least one additional reservoir for a liquid, to which each dosing chamber can be connected.

EP 0 354 130 A1 describes a method for adding a product to a liquid. In this case, a dose of the product to be added is determined and this dose is mixed into the main product.

U.S. Pat. No. 2,372,899 describes a bottle filling installation, in particular an installation for producing carbonated beverages into which syrup is mixed.

It may be desirable to provide an apparatus which, particularly in the case of beverages containing fruit pieces, prevents soiling or undesired splashes by the filling device. It may also be desirable to provide a possibility of equipping such an apparatus with standard filling devices, such as standard full-jet valves for example. Further, it may be desirable to reduce the costs of producing such installations.

SUMMARY OF INVENTION

In accordance with various aspects of the disclosure, an exemplary apparatus for filling containers with liquids and in particular with beverages comprises a filling device which fills the liquid into the container, wherein the filling device has a valve device for controlling the liquid flow into the container. The apparatus also comprises a first supply line for supplying a first liquid to the filling device. Also provided is a second supply line for supplying a second liquid to the filling device, said second liquid in particular being different from the first liquid, wherein the first supply line and the second supply line are separate from one another at least in some sections.

According to the disclosure, the apparatus has a control device which is configured in such a way that, at the start and at the end of a filling process for a given container, this container is filled only with the first liquid.

It is therefore proposed according to the disclosure that the container is filled in such a way that firstly the first liquid is filled in up to a certain quota, then quotas which also contain the second liquid are filled in and finally, at the end of the filling process, once again only the first liquid is filled into the given container.

In order to ensure that the second liquid is completely rinsed out in the case of small filling quantities, e.g. between 100 ml and 300 ml, the dosing of the second liquid may advantageously also be started here at the same point in time as the filling process.

Preferably, the first liquid is a clear liquid and/or a liquid which contains no fruit pieces and the like. It is thus ensured, particularly in the time segments in which the filling valve opens and closes, that no fruit pieces pass the latter. In this way, splashes due to the filling process are prevented. Furthermore, by virtue of this procedure, it is possible to use standard valves. More specifically, the situation is achieved whereby a pulp dose is located in the middle of the overall liquid dose which is filled into the container. No crushing of the pulp by the valve cone or other valve elements can thus occur.

In an exemplary method, the second supply line opens into the first supply line. This procedure may be suitable in a particularly advantageous manner for supplying pulp doses to the first liquid and/or for forming pulp plugs within the first liquid.

When bottling small filling quantities, e.g. between 100 ml and 300 ml, it has proven to be advantageous if the dosing of the second liquid takes place directly into the filling device and not into the first product line upstream of the filling device. It is thus ensured that sufficient first liquid is passed through the filling device after the plug of second liquid, in order to achieve complete rinsing of the second product out of the filling device.

In an exemplary embodiment, the apparatus has a measuring device for determining the quantity of the second liquid to be supplied. Advantageously, this measuring device has a measuring probe. This measuring probe can check for example the filling level in an intermediate container and in this way can ensure that only a predefined quantity of second liquid passes into the container.

In an exemplary embodiment, the apparatus has a dosing device for dosing the second liquid. By virtue of this dosing device, it can be ensured that in each case only certain quantities of liquid pass into the first liquid line. The abovementioned measuring device may advantageously form part of the dosing device.

A pulp dosage therefore preferably takes place by means of a probe. The use of a probe has the advantage that the conductivity of the pulp or of the second liquid need not be given. Furthermore, there may optionally be no need for a second annular container for the second liquid, since the dosing chamber is independent from upstream pressure fluctuations through valves on the inlet and outlet side.

In some aspects, the dosing device has at least one diaphragm valve. This means that the pulp dose is controlled by means of at least one diaphragm valve. This ensures a closing behaviour which is gentle on the product. In some aspects, the dosing device has two diaphragm valves. In an exemplary embodiment, the measuring probe or measuring device is arranged between these two diaphragm valves.

In an exemplary embodiment, the apparatus has a second measuring device which determines the quantity of liquid that has been filled into the container. This second measuring device may be for example a throughflow measuring device which may be provided downstream relative to the supply of the second liquid. In some aspects, however, this second measuring device is a weight measuring device which determines the weight of the bottle filled with the product. The valves of the filling devices can accordingly be controlled on the basis of the data from this second measuring device.

In an exemplary embodiment, the apparatus has a rinsing device for rinsing components of the apparatus with a rinsing medium. It is thus possible that a cleaning medium is conducted through the filling device in the context of a CIP cleaning process, but it is also possible that this rinsing medium or cleaning medium is conducted through the dosing device.

In an exemplary embodiment, the dosing device is incorporated into the method in such a way that an optionally separate CIP cleaning both of the first product path and of the second product path can also take place. As a result, for example, the main product can remain in the product path while the product path for e.g. pulp-containing bottling product is being cleaned. In this way, a rapid changeover of the filling apparatus from a first bottling product with a first additional product to a second bottling product with a second additional product can take place without any loss of the main product located in the product path.

The present disclosure also relates to a method for filling containers with liquids, such as for example with beverages, wherein a mixture of a first liquid and a second liquid is supplied to a container by means of a filling device and the first liquid is supplied to the filling device by means of a first supply line.

According to the disclosure, at the start and at the end of a filling process, only the first liquid is supplied to the container and, at least during a further time segment of the filling process between the start and the end of the filling process, at least also the second liquid is supplied to the container.

It is therefore also proposed with regard to the method that the start and the end of the filling process takes place using the first liquid which is in particular clear or free from fruit pieces. The time segment during which also the second liquid is supplied may be advantageously provided in a middle region of the overall temporal filling process.

In an exemplary method, the second liquid is dosed into the first supply line, in which the first liquid flows. This supply already into the first supply line means that a standard filling device can be used as the filling device.

In an exemplary method, a mixture of the first and second liquid is supplied to the container using a valve device, and the second liquid passes this valve device only in an essentially completely open state of the valve device. In this case, the second liquid is advantageously once again such a liquid which may contain fruit pieces or the like, i.e. for example pulp.

In an exemplary method, a filling state of the containers is measured. The filling state can be determined for example by means of load cells. A dosing may thus advantageously take place here by means of a weighing cell and advantageously also by means of a probe for the second liquid. In this way, a favourable standard deviation during the filling of the containers may be achieved.

Instead of measuring the respective doses, it would also be possible to carry out the dosing of the pulp via a timer switch or a similar dosing.

In an exemplary method, the second liquid is supplied marginally to the first liquid. By virtue of this marginal supply, it can be ensured in a particularly advantageous manner that, during the opening and closing process of the valve, the second liquid does not pass this valve.

In an exemplary method, a quantity to be supplied of the second liquid is determined, as has been explained in greater detail above.

Some further advantages and embodiments may become evident from the attached drawings.

BRIEF DESCRIPTION OF THE DRAWINGS

In the drawings:

FIG. 1 shows a schematic diagram of an installation for an apparatus for filling containers in accordance with various aspects of the disclosure;

FIG. 2 shows a schematic diagram of an apparatus for filling containers in accordance with various aspects of the disclosure;

DETAILED DESCRIPTION

Figure 3:
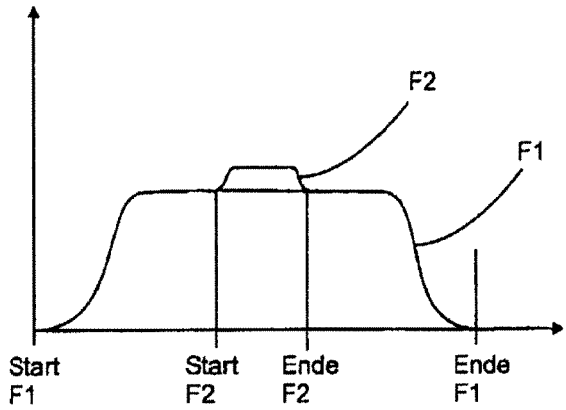
FIG. 3 shows a diagram illustrating the temporal progress of the filling operation.

FIG. 1 shows a schematic diagram of an installation 60 for filling containers. This installation 60 comprises a container supply 62 which supplies containers to a rinsing device 66 or rinser in the direction of the arrow P1 via an inlet starwheel 64.

According to various aspects, an outlet starwheel 68 of the rinsing device 66 picks up the rinsed containers and transfers them via a transfer starwheel 70 and a filler inlet starwheel 72 to an apparatus 1 for bottling the beverages. Here, two-component beverages are bottled using this apparatus 1. References A to G denote different method steps which are carried out during the bottling of the beverages. In a step A the container is pressed onto a filling device, and in a step B a preloading takes place and the container is acted upon by a gaseous medium, such as carbon dioxide for example. In a step C a clear filling of the container takes place with a main product, such as for example a carbonated beverage. In a step D a secondary product can be supplied or a secondary product plug can be filled into the main product. In the region E a topping-up of the main product takes place. Reference $T_E$ denotes the end of filling of the container with the beverage.

In a step F a settling or a release of pressure from the bottled beverage can be carried out, and in step G the container can be removed from the filling device.

Reference 78 denotes an outlet starwheel of the apparatus 1 and reference 80 denotes a closing device for closing the containers with caps, wherein reference 82 denotes a supply device for the container caps. Reference 84 denotes an outlet starwheel of the closing device and reference 86 denotes a discharge device for conveying away the filled containers.

Reference 76 denotes a dead angle in which no containers are filled and no containers are arranged at corresponding filling stations. In this dead angle between the filler outlet starwheel and the filler inlet starwheel, a dosing of the additional product to the main product is possible. This angle is thus also used for the filling process and in this way the overall performance of the filler can be increased. This dosing will be described in more detail with reference to the further figures. With regard to the method, therefore, it is proposed that the dosing of the further liquid to the first liquid takes place in a manner temporally offset from the filling of the container.

The apparatus shown in FIG. 1 thus serves also for mixing beverages composed of at least two or more different liquids. These liquids may be for example water, syrup and/or flavourings in a predefined mixing ratio per container volume to be filled. Here, too, the different liquids may be brought together in the space which follows the splitting to the individual filling valves. In the context of one aspect of the invention, it is proposed that the bringing-together of the different media takes place so close to the filling valve outlet that the dosed medium may be automatically dispensed with the subsequent container filling. By virtue of this procedure, each successive filling can be varied with a plurality of flavouring supplies. In addition, critical products such as pulp for example can in this way be rinsed away from the valve device or valve cone.

FIG. 2 shows a schematic diagram of an apparatus in accordance with the disclosure. According to various aspects, a filling device 2 fills a beverage into containers 10. A weight measuring device 24, such as a weighing cell, measures, in some aspects also continuously, a weight of the container filled with the liquid or the product. The filling process can be controlled on the basis of the data from this measuring device. It is pointed out that any control method known from the prior art for filling using a weighing cell can be used here, for example with regard to taring the weighing cell after picking up the containers or filling at a first filling rate and topping up at a second filling rate which differs from the first filling rate. The necessary control methods and implementation details of the filling devices are sufficiently well known to the person skilled in the art. Furthermore, it is pointed out that the term liquid is used hereinbelow, this term also being intended to encompass viscous media such as, for example, oils, honey, ketchup and the like.

This filling device has a valve device 4 or a valve body which can control the flow of liquid to the container or which can at least block or enable said flow.

The first liquid F1 is supplied to the filling device 2 from a reservoir 18 via a first supply line or liquid line 12. This first liquid F1 is in particular a clear liquid. Reference 42 denotes a drive unit for actuating the valve body 4.

Via a second supply line 14, which in this case opens into the first supply line 12, the filling device 2 is supplied with a further liquid which may in this case be pulp. This second liquid is supplied to the first supply line 12 via a feed line 15, a dosing device 20 and a supply line 14. The supply of the second liquid takes place as indicated by the black dots F2, marginally into the first liquid F1. In some aspects, these margins are supplied in such a way that, at the start and at the end of a process of filling the containers 10, only the first liquid F1 is supplied. The dosing unit 20 has two diaphragm valves 44 and 46 for dosing the second liquid, i.e. in this case the pulp. A measuring device 22 which has a measuring probe 26 is provided between these two diaphragm valves in order to check the respectively supplied margin of liquid F2. Reference 26 denotes a suitable capacitive probe.

A control device 30 controls the valve device 4. Furthermore, this control device 30 also controls the two diaphragm valves 44 and 46 in order in this way to achieve a precise dose of the second liquid F2. References 32, 34 and 36 denote appropriate (electric) line connections between the control device and said elements. The measuring probe 26 is also connected to the control device via a line connection 38. It can also be seen that the filling level of the second liquid is higher than the filling level of the first liquid F1. This difference in filling level is denoted by reference U. This ensures that the second liquid F2 can always be pushed into the first liquid F1.

Reference 52 denotes a CIP dispenser for carrying out a CIP cleaning process. The CIP dispenser is represented by the connection between the apparatus 1 and a CIP installation (not shown) and is sufficiently well known to the person skilled in the art with regard to its structure and possible embodiments. It can be seen here that a connecting line 54 cleans both the filling device 4 via an annular cleaning channel 56 and also components of the dosing unit 20 via a rinsing line 45. Reference 48 denotes an annular channel for supplying the second liquid F2.

FIG. 3 illustrates the progress of the method during the filling of the container 10. Firstly, as indicated by reference F1, only the first liquid is supplied (time Start F1). At a given time (Start F2), the supply of the second liquid F2 also begins, and this ends at a future time End F2. Only after the end of the filling with the product F2 does the filling with the liquid F1 also end (time End F1). In order to achieve a central supply of the second liquid F2 in this way, account is also advantageously taken of the volumes located in the supply line 12 after the supply through the supply line 14 (cf. FIG. 2).

Figure 4:
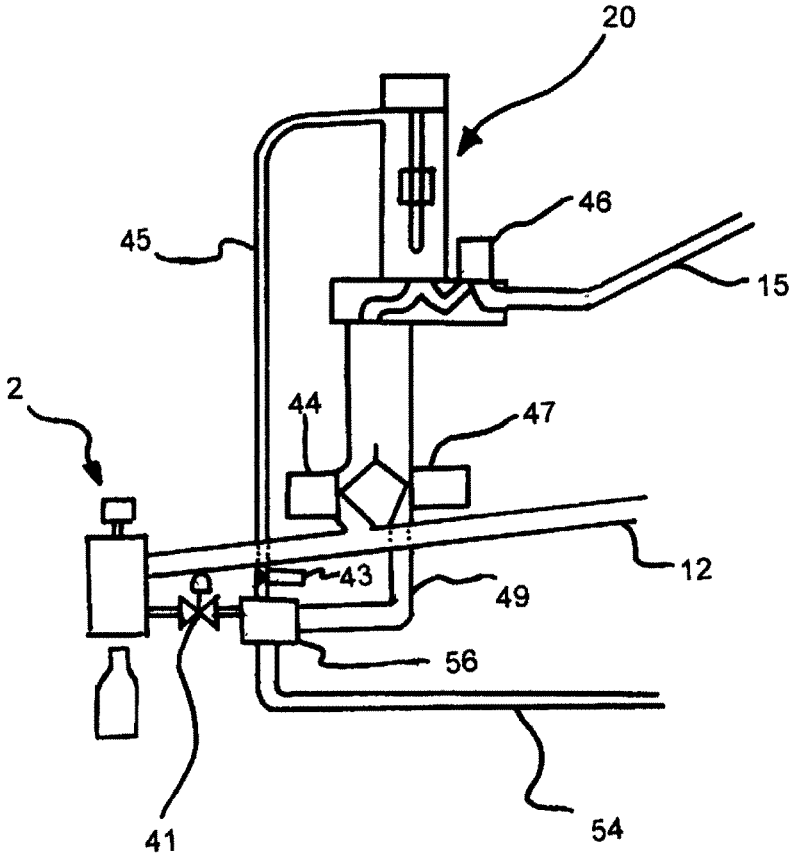
FIG. 4 shows an exemplary embodiment of a dosing device for an apparatus for filling containers.

FIG. 4 shows an exemplary embodiment of the method-related integration of the dosing unit into the product and cleaning paths. Here, an additional rinsing line 49 is incorporated in addition to the components shown in FIG. 2. This rinsing line 49 branches off from the second supply line 14 directly before the diaphragm valve 44, as far as possible without creating any dead space, and can be shut off at this branching point by a further e.g. diaphragm valve 47. Moreover, a further shut-off valve is incorporated between the annular cleaning channel 56 and the filling device 2. With this circuit for the method, a separate cleaning e.g. of the second product path for the e.g. pulp-containing product can take place.

To this end, the shut-off valve 41 and also the diaphragm valves 44 and 47 are closed. The diaphragm valves 43 and 46 are opened. Cleaning medium can then be conducted via the feed line 15 through the measuring device 22, shown here with a floating probe, and also the rinsing line 45, the annular channel 48 and the connecting line 54. Once the measuring device 22 has been sufficiently rinsed, the diaphragm valve 47 is opened. Since the second supply line 14 and also the rinsing line 49 in each case have a larger diameter than the rinsing line 45, the main flow of cleaning medium is now conducted from the measuring device 22 through the line 14 and the rinsing line 49 to the annular cleaning channel 56. It is also possible to close the diaphragm valve 43, as a result of which the entire flow of cleaning medium runs through the last-mentioned path. After the cleaning with e.g. sodium hydroxide solution, a cleaning with acid for example takes place in the same way, followed by a post-rinsing process using water to remove all the cleaning media.

Finally, the valves 41 and 47 are closed. A second liquid can then be passed into the dosing device via the feed line 15 for the purpose of bottling in combination with the first liquid. This additional product may in this case differ from the originally bottled product.

As shown in FIG. 2, the two liquids F1 and F2 or products are supplied from above, resulting in a reduced loss of product since the product supplied in product lines supplied from below cannot be bottled in such a way as to empty all the residue. The dosing takes place as mentioned, with the aid of the weighing cell 24 and the measuring device 22. It is pointed out that the filling apparatus shown here can also be retrofitted on existing installations. In this case, the original design of the filling apparatus is not important. However, a time-based control is also possible instead of or in addition to the control of the supply shown in FIG. 3.

It will be apparent to those skilled in the art that various modifications and variations can be made to the apparatuses and method for filling containers of the present disclosure without departing from the scope of the invention. Other embodiments of the invention will be apparent to those skilled in the art from consideration of the specification and practice of the invention disclosed herein. It is intended that the specification and examples be considered as exemplary only.

What is claimed is:

1. Apparatus for filling containers with liquids, comprising a filling device which fills the liquid into the container, wherein the filling device has a valve device for controlling the liquid flow into the container, comprising a first supply line for supplying a first liquid to the filling device, and comprising a second supply line for supplying a second liquid to the filling device, wherein the two liquids are beverages and the second liquid contains fruit pieces or pulp fractions, and wherein the first supply line and the second supply line are separate from one another at least in some sections and the second supply line opens into the first supply line, characterised in that the apparatus has a control device which is configured in such a way that, at the start and at the end of a filling process for a container, this container is filled only with the first liquid and comprising a dosing device for dosing the second liquid, wherein the dosing device comprises a measuring device for determining the quantity of the second liquid to be supplied, which is provided within the second supply line, wherein the measuring device has a measuring probe and wherein the dosing device has two diaphragm valves and the measuring probe is arranged between the two diaphragm valves, further comprising a rinsing device for rinsing components of the apparatus with a rinsing medium and wherein a filling state of the containers is measured.

2. Apparatus according to claim 1, further comprising a second measuring device which determines the quantity of liquid that has been filled into the container.

3. Method for filling containers with liquids, wherein a mixture of a first liquid and a second liquid is supplied to a container by means of a filling device and the first liquid is supplied to the filling device by means of a first supply line and the second liquid is dosed into the first supply line, wherein the two liquids are beverages and the second liquid contains fruit pieces or pulp fractions, characterised in that, at the start and at the end of a filling process, only the first liquid is supplied to the container and, at least during a further time segment of the filling process between the start and the end of the filling process, at least also the second liquid is supplied to the container and wherein a quantity to be supplied of the second liquid is determined by means of a probe of a measuring device, which is provided within the second supply line, and wherein the measuring device forms part of a dosing device that doses the second liquid and wherein the dosing device has two diaphragm valves and the measuring probe is arranged between the two diaphragm valves, wherein a rinsing device is comprised, which can rinse components of the apparatus with a rinsing medium and wherein a filling state of the containers is measured.

4. Method according to claim 3, wherein the mixture is supplied to the container using a valve device, and the second liquid passes this valve device only in an essentially completely open state of the valve device.

5. Method according to claim 3, wherein the second liquid is supplied marginally to the first liquid.

6. Method according to claim 3, wherein the measuring probe checks the filling level in an intermediate container.

7. Apparatus according to claim 1, wherein the measuring device forms part of the dosing device.

* * * * *